US011710927B2

(12) United States Patent
Azad et al.

(10) Patent No.: US 11,710,927 B2
(45) Date of Patent: Jul. 25, 2023

(54) ELECTRICAL CONNECTOR WITH CONNECTOR POSITION ASSURANCE AND MECHANICAL ASSIST

(71) Applicant: Lear Corporation, Southfield, MI (US)

(72) Inventors: Vikas Azad, New Hudson, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/335,166

(22) Filed: Jun. 1, 2021

(65) Prior Publication Data

US 2022/0384992 A1 Dec. 1, 2022

(51) Int. Cl.
*H01R 13/629* (2006.01)
*H01R 13/639* (2006.01)
*H01R 13/627* (2006.01)

(52) U.S. Cl.
CPC ... *H01R 13/62927* (2013.01); *H01R 13/6272* (2013.01); *H01R 13/639* (2013.01)

(58) Field of Classification Search
CPC ..... H01R 13/629; H01R 13/639; H01R 13/6271; H01R 13/6275; H01R 13/62927; H01R 13/641
See application file for complete search history.

(56) References Cited

U.S. PATENT DOCUMENTS 4,746,306 A * 5/1988 Yurtin ..... H01R 13/641 439/352
5,236,373 A * 8/1993 Kennedy ..... H01R 13/639 439/352
5,720,623 A * 2/1998 Polenick ..... H01R 13/641 439/352
5,910,027 A * 6/1999 Wayt ..... H01R 13/6272 439/352
6,261,115 B1 * 7/2001 Pederson ..... H01R 13/6272 439/352
6,530,799 B2 3/2003 Regnier et al.
6,659,789 B2 * 12/2003 Nagamine ..... H01R 13/639 439/352
7,326,074 B1 * 2/2008 Lim ..... H01R 13/629 439/352
9,281,614 B1 3/2016 Bonucci et al.
9,490,576 B2 * 11/2016 Plazio ..... H01R 13/639
10,038,278 B2 * 7/2018 Lane ..... H01R 13/6272
10,050,382 B2 * 8/2018 Droesbeke ..... H01R 13/426
10,109,950 B1 * 10/2018 Campbell ..... H01R 13/05
(Continued)

*Primary Examiner* — Thanh Tam T Le
(74) *Attorney, Agent, or Firm* — MacMillan, Sobanski & Todd, LLC

(57) ABSTRACT

A connector pair includes a header with a protrusion and an electrical connector assembly movable relative to the header between a mated position and an unmated position. The electrical connector assembly includes a connector housing and a connector position assurance retained on the connector housing for relative linear movement between a lock position and an open position. The connector position assurance includes a first lock surface that engages a second lock surface on the protrusion to retain the electrical connector assembly in the mated position. The connector position assurance includes a first assist surface that engages a second assist surface on the protrusion to move the electrical connector assembly from the mated position toward the unmated position.

17 Claims, 12 Drawing Sheets

(56) References Cited

U.S. PATENT DOCUMENTS

| | | | | |
|---|---|---|---|---|
| 10,116,095 | B1 * | 10/2018 | Sundarakrishnamachari | H01R 13/641 |
| 10,135,172 | B1 * | 11/2018 | Foltz | H01R 13/6272 |
| 10,135,189 | B2 * | 11/2018 | Holub | H01R 13/6271 |
| 10,404,012 | B1 * | 9/2019 | Stoyanov | H01R 13/641 |
| 10,811,820 | B2 * | 10/2020 | Ohfuku | H01R 13/641 |
| 10,819,067 | B2 * | 10/2020 | Kanda | H01R 13/426 |
| 11,018,450 | B2 * | 5/2021 | Holub | H01R 13/4362 |
| 11,177,612 | B2 * | 11/2021 | Chiang | H01R 13/436 |
| 2004/0002253 | A1 | 1/2004 | Pavlovic et al. | |
| 2004/0248453 | A1 | 12/2004 | McLauchlan et al. | |
| 2009/0221167 | A1 | 9/2009 | Pittenger et al. | |
| 2012/0302084 | A1 | 11/2012 | Daugherty et al. | |
| 2020/0313350 | A1 | 10/2020 | Holub et al. | |

* cited by examiner

ELECTRICAL CONNECTOR WITH CONNECTOR POSITION ASSURANCE AND MECHANICAL ASSIST

BACKGROUND OF THE INVENTION

This invention relates to an electrical connector. More specifically, this invention relates to an electrical connector with a mechanical assist.

An electrical connector assembly is typically used to hold multiple electrical terminals in selected positions. The electrical connector can be mated with a corresponding connector in order to mate each of the electrical terminals with a corresponding terminal provided in the corresponding connector. This allows an operator to make multiple electrical connections simultaneously by plugging the electrical connector into the corresponding connector.

Conventional vehicles include an increasing number of electrical components which, in turn, call for an increasing number of electrical connections. As a result, electrical connectors in conventional vehicles include an increasing number of electrical terminals. This increased number of terminals increases the amount of force that must be used in order to connect the electrical connector to the corresponding connector and to disconnect the electrical connector from the corresponding connector. In order to make these actions easier for the operator, it is known to provide electrical connector with an assist lever, such as shown in U.S. Pat. No. 9,281,614. The assist lever is mechanical assist that provides the operator with a mechanical advantage when connecting or disconnecting the connectors.

It is also known to provide a connector position assurance so that the operator is able to ensure that the electrical connector is properly mated with the corresponding connector. The connector position assurance is typically attached to either the electric connector or the corresponding connector. The connector position assurance can be moved to a final position when the electrical connector is properly mated with the corresponding connector to provide confirmation that the connectors and all the electric terminals are properly mated. It would be advantageous to have an improved electric connector with a connector position assurance.

SUMMARY OF THE INVENTION

This invention relates to a connector pair. The connector pair includes a header with a protrusion and an electrical connector assembly movable relative to the header between a mated position and an unmated position. The electrical connector assembly includes a connector housing and a connector position assurance retained on the connector housing for relative linear movement between a lock position and an open position. The connector position assurance includes a first lock surface that engages a second lock surface on the protrusion to retain the electrical connector assembly in the mated position. The connector position assurance includes a first assist surface that engages a second assist surface on the protrusion to move the electrical connector assembly from the mated position toward the unmated position.

In another embodiment, the invention relates to a connector pair includes a header with a protrusion. The connector pair also includes an electrical connector assembly. The electrical connector assembly is movable relative to the header from an unmated position to a mated position. The electrical connector assembly includes a connector housing. A connector position assurance is retained on the connector housing for relative linear movement. When the electrical connector assembly is moved from the unmated position toward the mated position to an intermediate position, the protrusion engages the connector position assurance to move the connector position assurance relative to the connector housing from a lock position to an open position. When the electrical connector assembly is moved from the intermediate position to the mated position, the connector position assurance is moved relative to the connector housing to the lock position. When the connector position assurance is in the lock position the protrusion engages the connector position assurance to retain the electrical connector assembly in the mated position. When the electrical connector assembly is in the mated position and the connector position assurance is moved relative to the connector housing toward the open position, the connector position assurance engages the protrusion to move the electrical connector assembly relative to the header from the mated position toward the unmated position.

In another embodiment, the invention relates to an electrical connector assembly. The electrical connector assembly includes a connector housing. The connector housing has a connector base and a plurality of connector walls that extend from the connector base in a mate direction. The connector walls define a terminal space. A connector position assurance housing is on one of the connector walls. The connector position assurance housing defines a connector position assurance space. An opening is located in one of the connector walls. The opening extends from the terminal space to the connector position assurance space. A connector position assurance is supported in the connector position assurance housing for movement relative to the connector housing. The connector position assurance includes a plurality of ramp surfaces on a side facing the opening.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
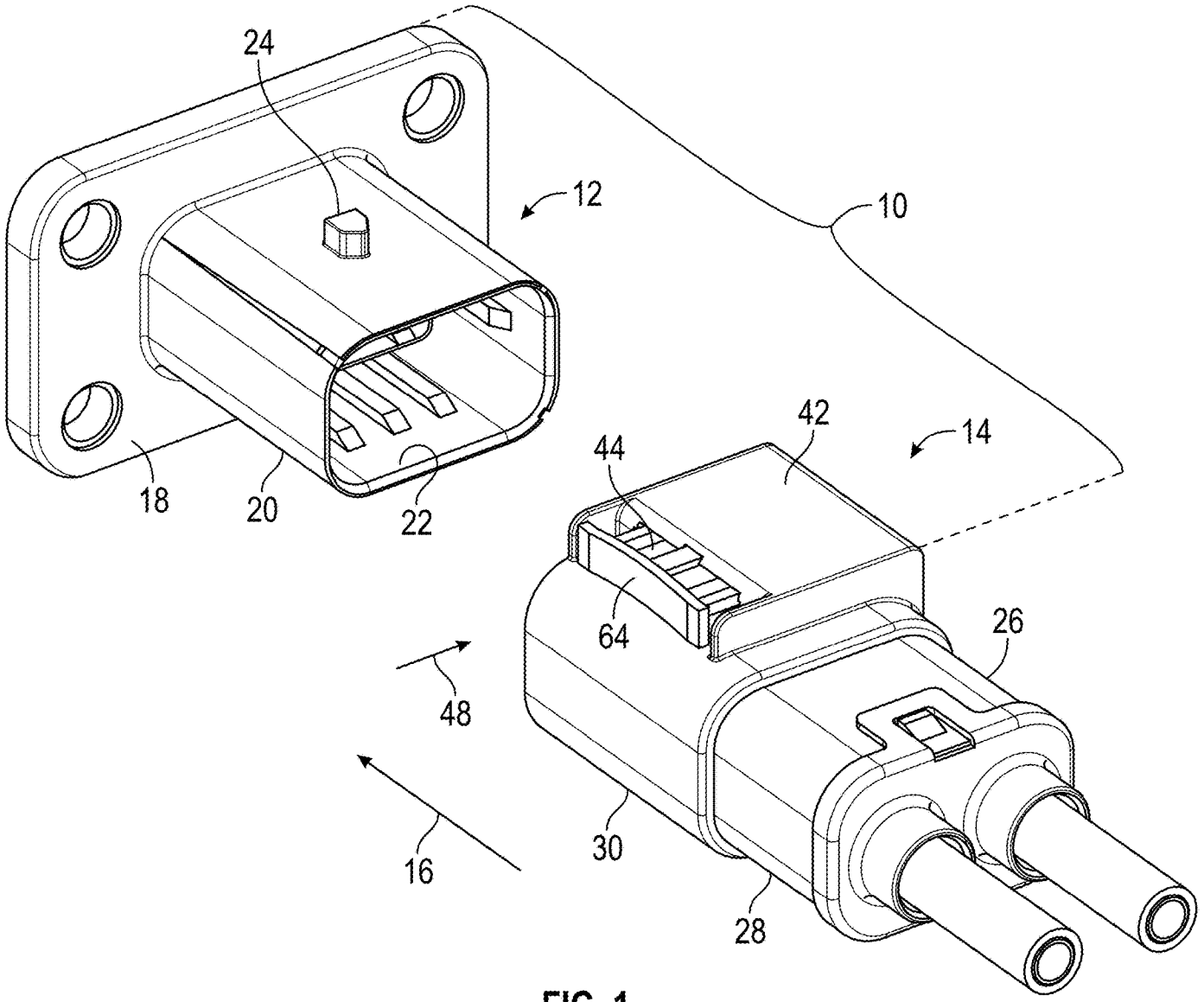
FIG. 1 is a perspective view of an electrical connector assembly and a header in an unmated position.
Figure 2:
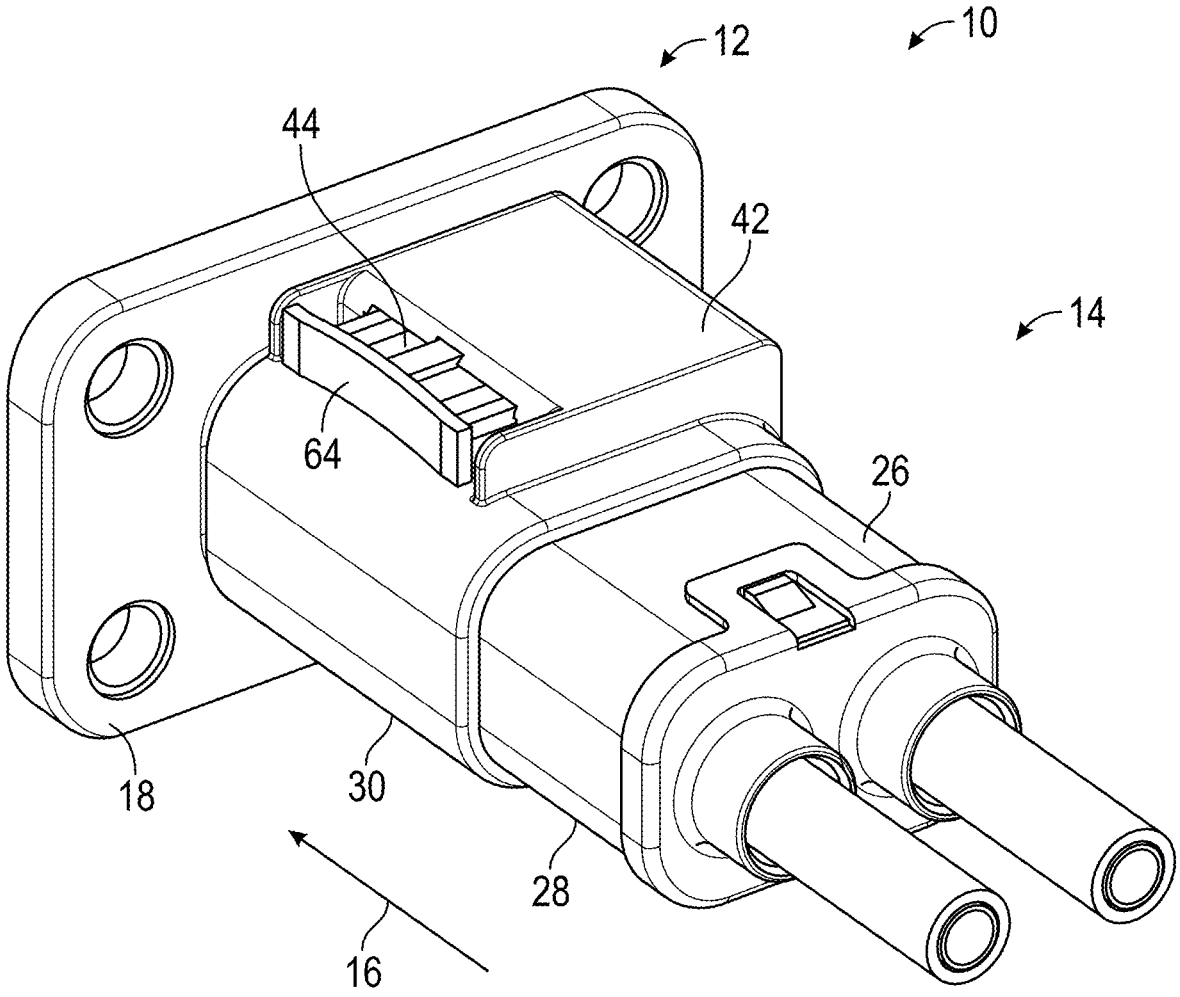
FIG. 2 is a perspective view similar to FIG. 1 showing the electric connector assembly and the header in a mated position.

Referring now to the drawings, there is illustrated in FIG. 1 a perspective view of a connector pair, indicated generally at 10. The connector pair 10 includes a header, indicated generally at 12, and an electrical connector assembly, indicated generally at 14. The header 12 and the electrical connector assembly 14 are shown separated from each other in FIG. 1. Referring to FIG. 2, there is illustrated a perspective view of the connector pair 10 with the electrical connector assembly 14 shown in a mated position relative to the header 12.

The header 12 supports one or more header terminals (not shown), and the electrical connector assembly 14 supports one or more connector terminals (not shown). When the electrical connector assembly 14 is in the mated position relative to the header 12, each of the header terminals is mated with a respective one of the connector terminals, as is known in the art. From the unmated position illustrated in FIG. 1, the electrical connector assembly 14 can be moved in a mate direction 16 relative to the header 12 in order to mate the connector pair 10, as is described below.

The illustrated header 12 is molded from plastic, but may be made of any desired material using any desired process. The header 12 includes a header base 18 and a plurality of header walls 20 that extend from the header base 18 parallel to the mate direction 16. The header walls 20 define a header terminal space 22 therebetween, and the header terminals are located at least in part within the header terminal space 22. The header 12 includes a protrusion 24 that extends outwardly from one of the header walls 20, perpendicular to the mate direction 16. The protrusion 24 will be described will be described in detail below.

The illustrated electrical connector assembly 14 includes a connector housing 26. The illustrated connector housing 26 is molded from plastic, but may be made of any desired material using any desired process. The connector housing 26 includes a connector base 28 and a plurality of connector walls 30 that extend from the connector base 28 parallel to the mate direction 16.

Figure 3:
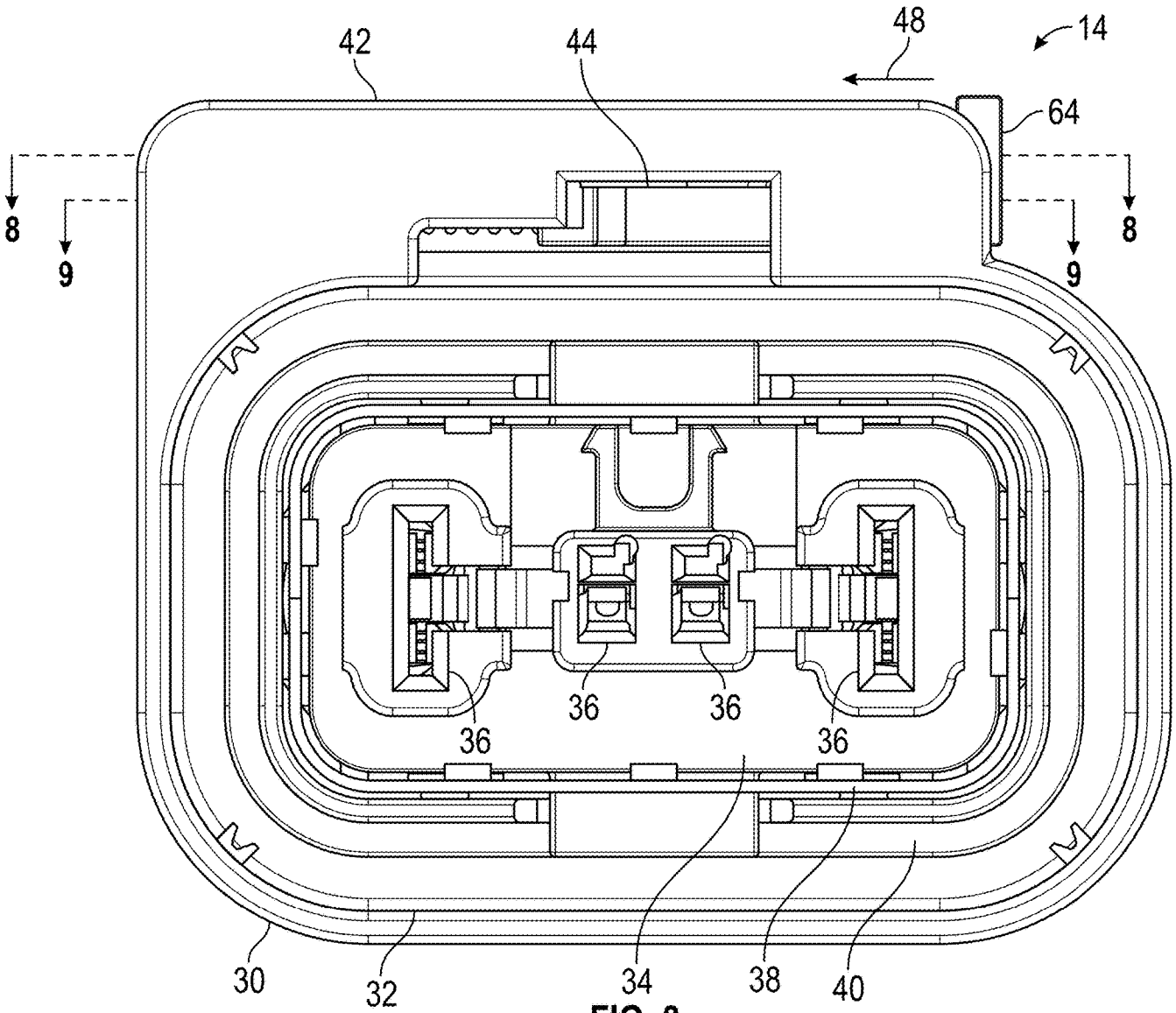
FIG. 3 is an end view of the electrical connector assembly illustrated in FIG. 1.

Referring to FIG. 3, there is illustrated an end view of the electrical connector assembly 14. The illustrated view is taken parallel to the mate direction 16. The connector walls 30 define a connector terminal space 32 therebetween. The electrical connector assembly 14 includes an inner housing 34 that is located at least partially within the connector terminal space 32. The illustrated inner housing 34 is molded from plastic, but may be made from any desired material using any desired process. The inner housing 34 includes a plurality of terminal cavities 36 that accommodate the connector terminals. The illustrated inner housing 34 includes two large cavities for primary terminals and two smaller cavities for interlock loop terminals, but may include any desired type and number of terminal cavities 36. The illustrated electrical connector assembly 14 includes an electromagnetic shield 38 that is located around the inner housing 34.

The connector housing 26 also defines a header wall space 40 that is located within the connector walls 30 and around the inner housing 34. When the electrical connector assembly 14 is mated with the header 12, the header walls 20 are located at least in part within the header wall space 40.

The electrical connector assembly 14 also includes a connector position assurance housing (CPA housing) 42 located on one of the connector walls 30. The illustrated CPA housing 42 is molded as part of the connector housing 26. The CPA housing 42 holds a connector position assurance (CPA) 44 for movement relative to the connector housing 26, as is described below.

Figure 4:
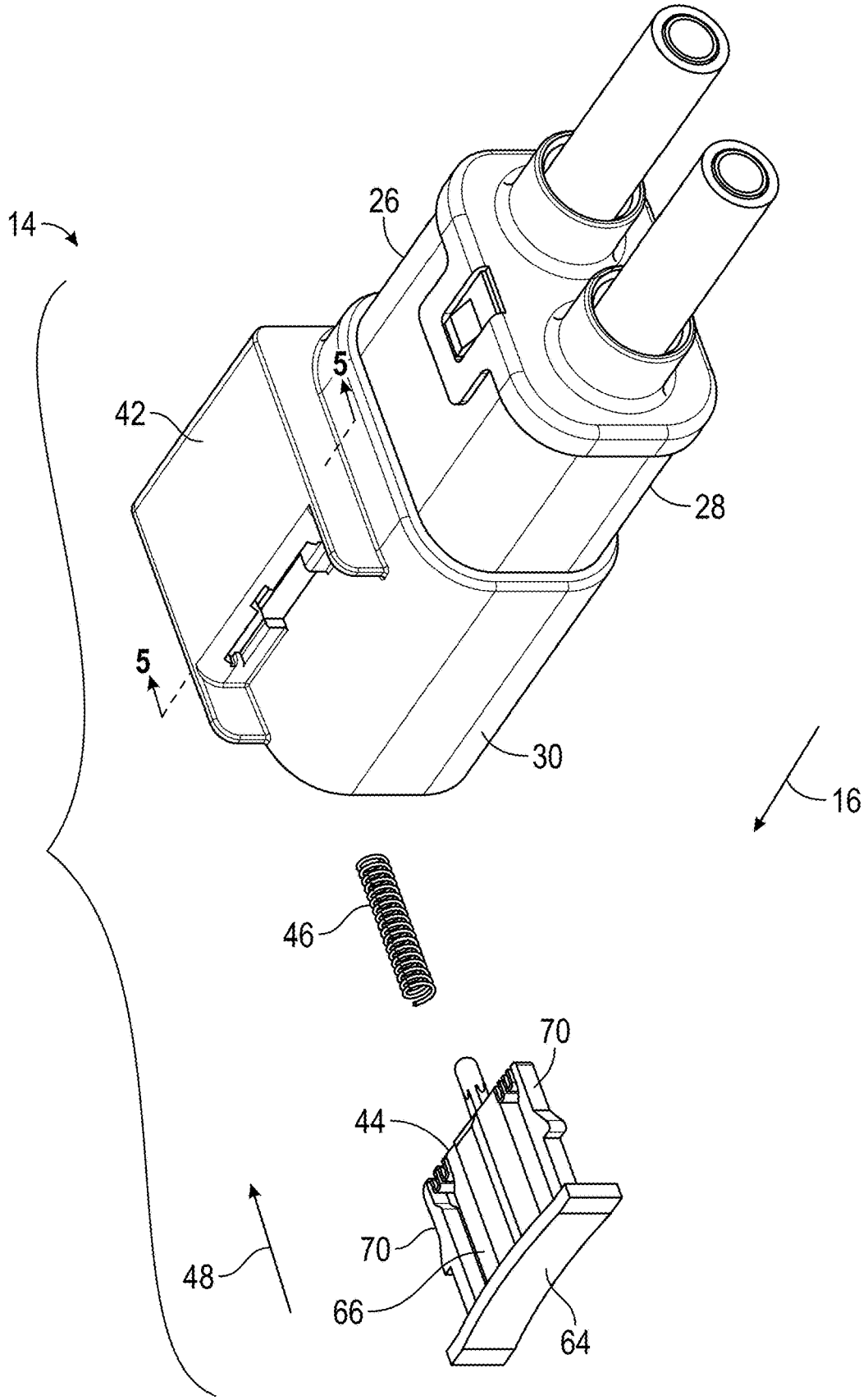
FIG. 4 is an exploded perspective view of the electrical connector assembly illustrated in FIGS. 1 and 2.

Referring to FIG. 4, there is illustrated an exploded perspective view of the electrical connector assembly 14. The CPA 44 and a spring 46 are shown separated from the connector housing 26. The CPA 44 can be moved in a CPA direction 48 relative to the connector housing 26 in order to insert the CPA 44 into the CPA housing 42, as will be described below.

Figure 5:
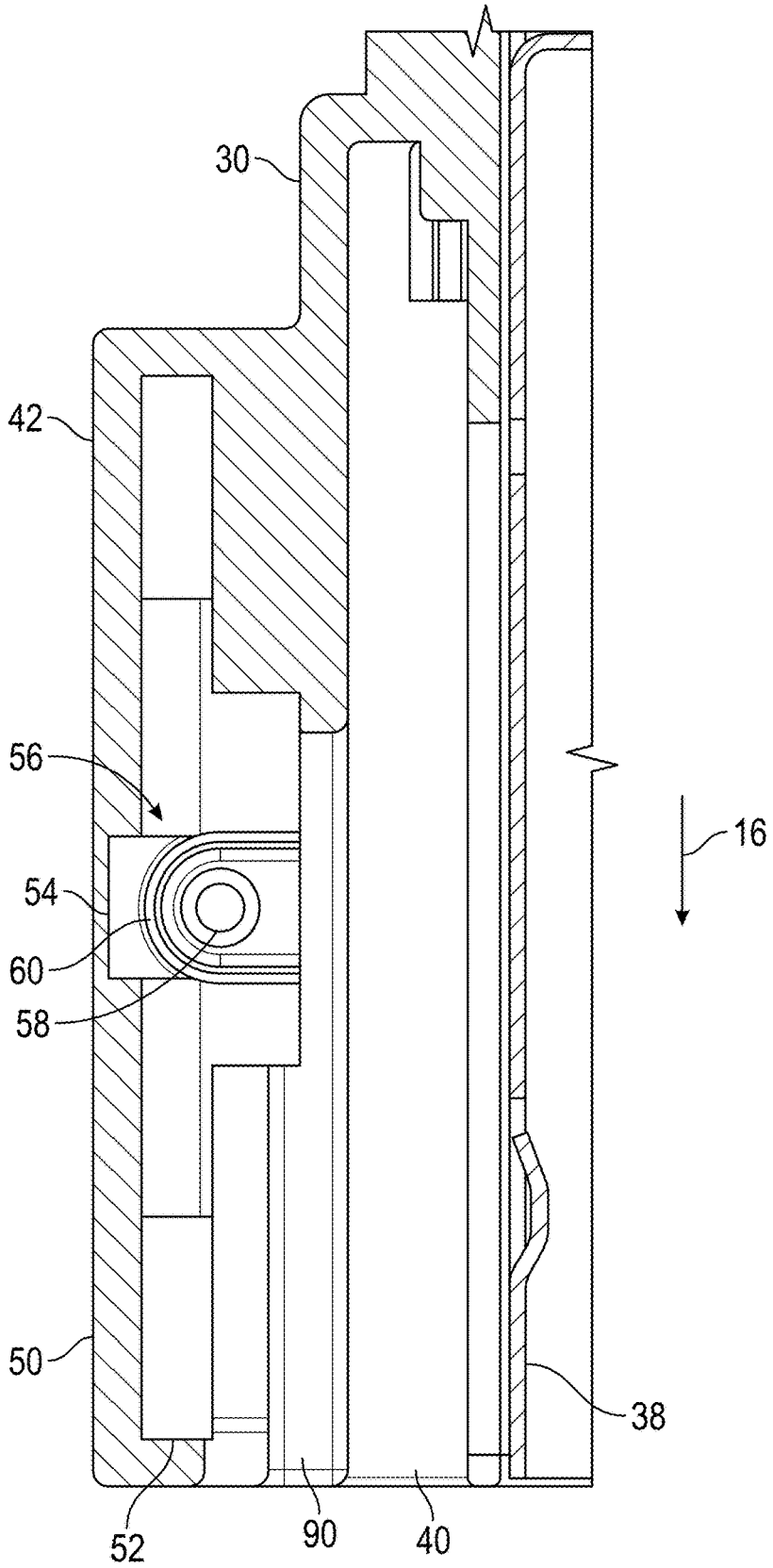
FIG. 5 is a cross-sectional view taken along line 5-5 of FIG. 4.

Referring to FIG. 5, there is illustrated a cross-sectional view of a portion of the connector housing 26 taken along line 5-5 of FIG. 4 and showing the interior of the CPA housing 42. The view in FIG. 5 is taken along the CPA direction 48. The CPA housing 42 includes an outer wall 50 that is spaced apart from the connector wall 30, and a CPA space 52 is defined therebetween. The CPA housing 42 includes a housing guide 54. The housing guide 54 restricts the movement of the CPA 44 relative to the connector housing 26, as described below. The illustrated housing guide 54 is a notch in the outer wall 50 that extends parallel to the CPA direction 48.

The CPA housing 42 also includes a spring guide, indicated generally at 56. The spring guide 56 contains the spring 46 during assembly and use of the electrical connector assembly 14, as described below. The spring guide 56 includes a guide pin 58 that extends in the CPA direction 48 and a spring cover 60 that is spaced apart from the guide pin 58 and also extends in the CPA direction 48.

Figure 6:
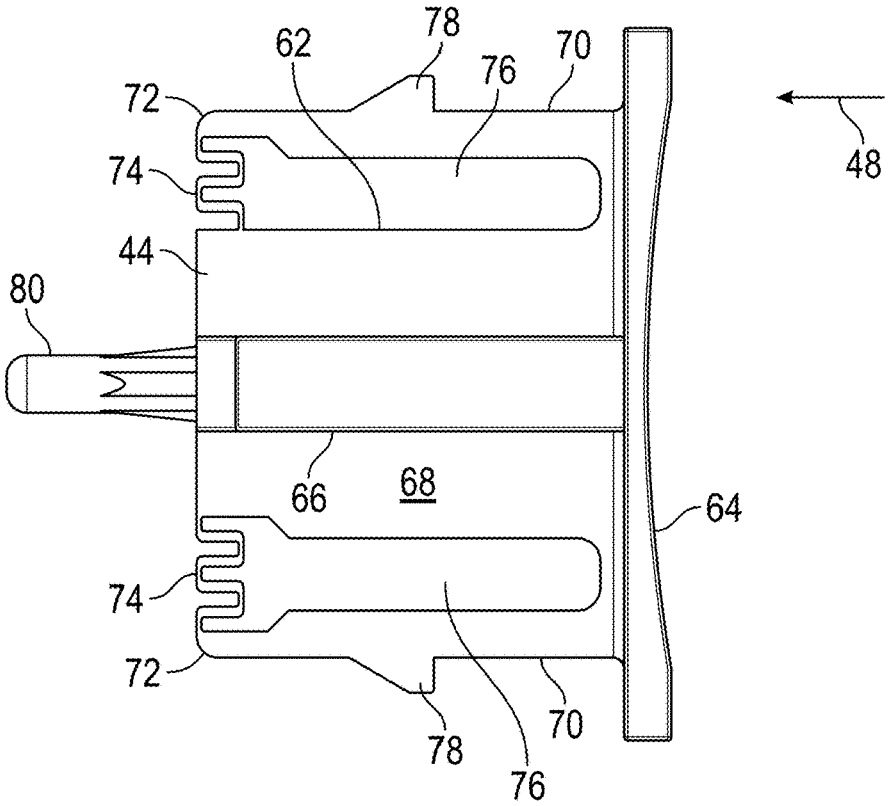
FIG. 6 is a top plan view of a connector position assurance of the electrical connector assembly.
Figure 7:
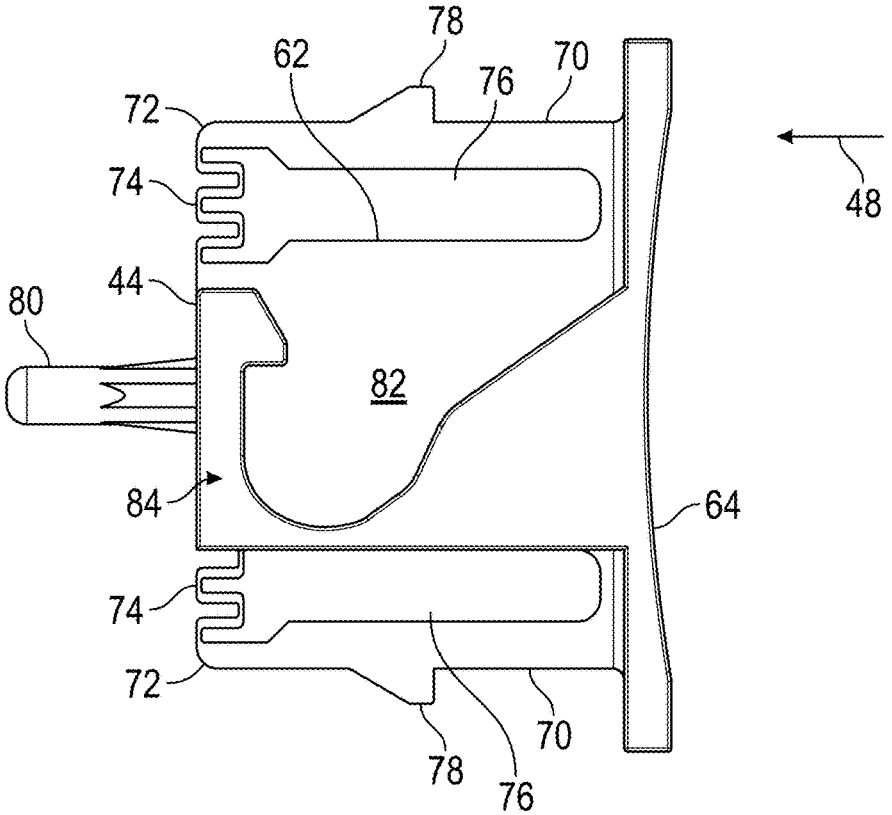
FIG. 7 is a bottom plan view of the connector position assurance illustrated in FIG. 6.

Referring now to FIG. 6, there is illustrated a top plan view of the CPA 44 and, in FIG. 7, there is illustrated a bottom plan view of the CPA 44. The illustrated CPA 44 is molded from plastic, but may be made from any desired material and by any desired process. The CPA 44 includes a CPA body 62. A push surface 64 is provided on the CPA body 62. The push surface 64 allows an operator to apply a force to the CPA 44 in the CPA direction 48. In the illustrated embodiment, the push surface 64 is a curved surface adapted to allow a human operator to push the CPA 44 using a finger. However, the push surface 64 may be any desired surface and may be adapted to accommodate the use of a tool or machine to apply the force to the CPA 44. The CPA 44 includes a CPA guide 66. The illustrated CPA guide 66 is a ridge on a first side 68 of the CPA body 62 that extends in the CPA direction 48. When the electrical connector assembly 14 is assembled, the CPA guide 66 cooperates with the housing guide 54 (shown in FIG. 5) to limit movement of the CPA 44 to the CPA direction 48 relative to the connector housing 26.

The CPA 44 includes two lock arms 70. Each of the lock arms 70 is fixed to the CPA body 62 at one end, adjacent to the push surface 64. Each lock arm 70 extends in the CPA direction 48 to a respective end 72. Each lock arm 70 includes an arm spring 74 that biases the end 72 of the respective lock arm 70 to a rest position shown in FIGS. 6 and 7. In the illustrated embodiment, the arm springs 74 are integrally molded as part of the CPA 44. However, any desired type of spring may be used. The illustrated molded arm springs 74 also serve to prevent objects from entering spaces 76 defined between the CPA body 62 and the lock arms 70. Each of the lock arms 70 includes a latch 78, which will be described below. The CPA 44 also includes a CPA pin 80 that extends from the CPA body 62 in the CPA direction 48.

As shown in FIG. 7, a second side 82 of the CPA 44 includes a plurality of ramp surfaces, indicated generally at 84. The ramp surfaces 84 extend outwardly from the second side 82 of the CPA 44 and are provided to interact with the protrusion 24 on the header 12 as will be described in detail below.

Figure 8:
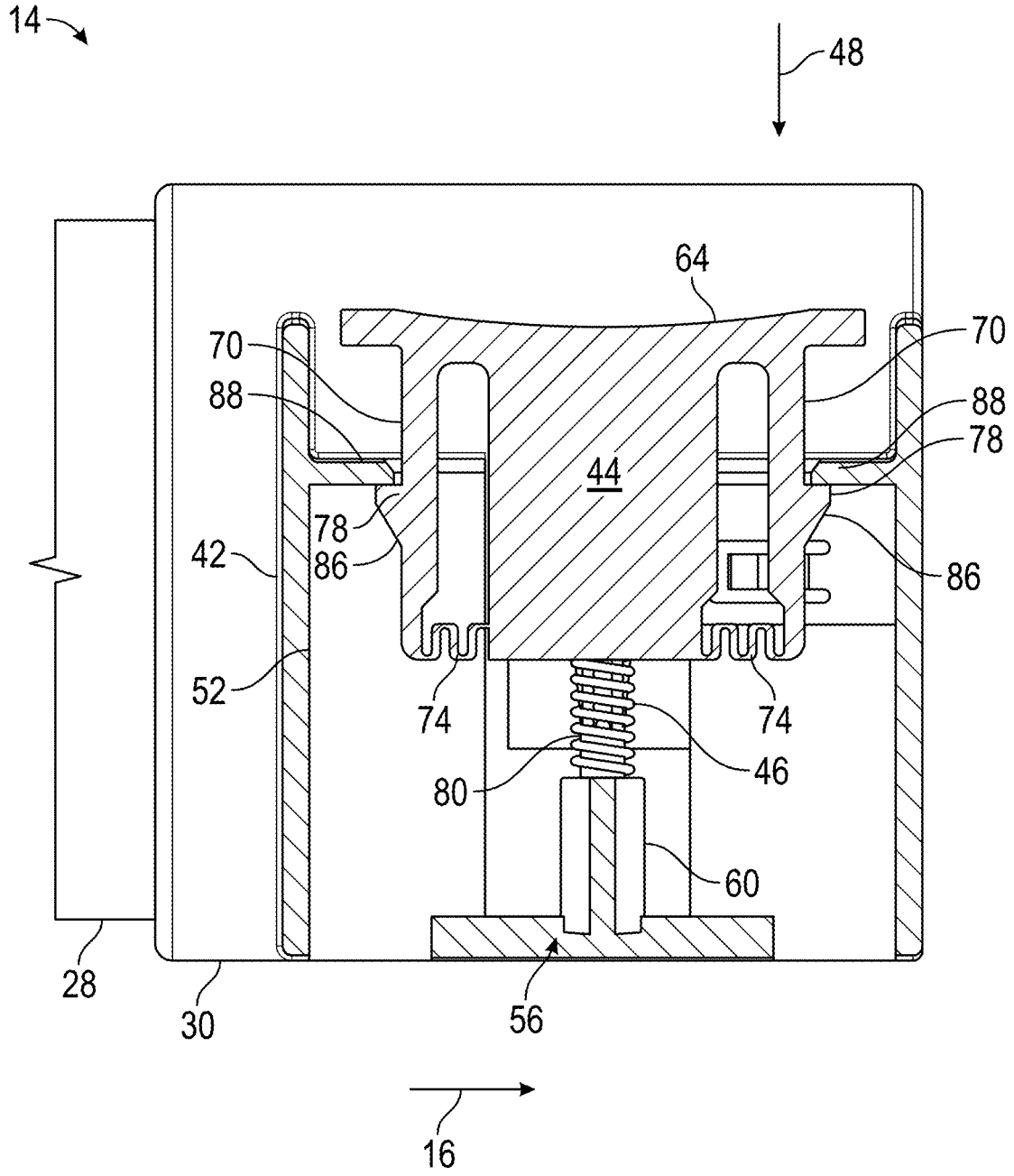
FIG. 8 is a cross-sectional view taken along line 8-8 of FIG. 3.

Referring to FIG. 8, there is illustrated a cross-sectional view taken along line 8-8 of FIG. 3 that shows the CPA 44 shown attached to the connector housing 26 and in a lock position relative to the CPA housing 42. To attach the CPA 44 to the connector housing 26, the spring 46 is initially placed on the CPA pin 80, and then the CPA 44 is moved in the CPA direction 48 relative to connector housing 26 into the CPA space 52. The CPA guide 66 is positioned in the housing guide 54 and prevents the CPA 44 from moving relative to the connector housing 26 other than parallel to the CPA direction 48.

As the CPA 44 is inserted into the CPA housing 42, lead surfaces 86 on the latches 78 engage lock walls 88 on the CPA housing 42. As a result, the lock arms 70 are deflected toward the CPA body 62, compressing the arm springs 74. When the CPA 44 has been moved far enough in the CPA direction 48 such that the latches 78 are moved past the lock walls 88, the lock arms 70 rebound to their respective rest positions. As a result, the latches 78 engage the lock walls 88 to prevent the CPA 44 from being moved opposite the CPA direction 48 and out of the CPA housing 42.

Figure 9:
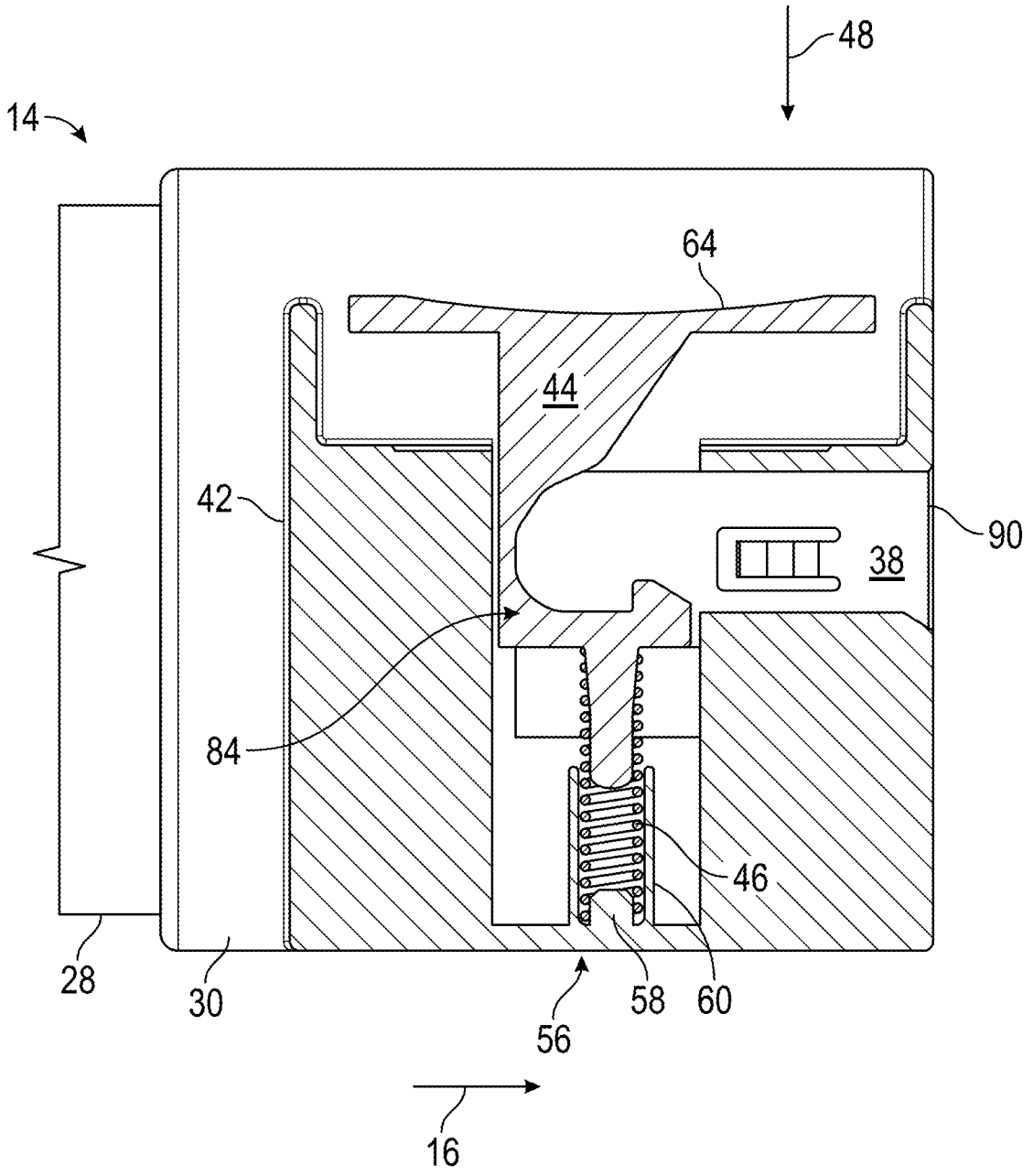
FIG. 9 is a cross-sectional view taken along line 9-9 of FIG. 3.

Additionally, as the CPA 44 is inserted into the CPA housing 42, the spring 46 is inserted into the spring guide 56. Referring to FIG. 9, a cross-sectional view taken along line 9-9 of FIG. 3 is illustrated, showing the CPA 44 in the lock position in the CPA housing 42. The CPA 44 is shown in the same position in FIGS. 8 and 9. The spring 46 is positioned inside the spring cover 60 and around the guide pin 58. Additionally, a portion of the CPA pin 80 extends inside the spring cover 60. This maintains the orientation of the spring 46 extending in the CPA direction 48 and prevents deflection of the spring 46. The spring 46 is compressed between the CPA 44 and the spring guide 56 and, thus, biases the CPA 44 in a direction that is opposite to the CPA direction 48. As previously described in reference to FIG. 8, the latches 78 prevent movement of the CPA 44 in the direction that is opposite to the CPA direction 48. Thus, the CPA 44 is held in the lock position illustrated in FIGS. 8 and 9.

The cross-section illustrated in FIG. 9 is taken through the ramp surfaces 84 on the second side 82 of the CPA 44. The electrical connector assembly 14 is shown as it is illustrated in FIG. 1, prior to being mated to the header 12. The interaction between the ramp surfaces 84 and the protrusion 24 on the header 12 will be described below with reference to FIGS. 9 through 13.

Figure 10:
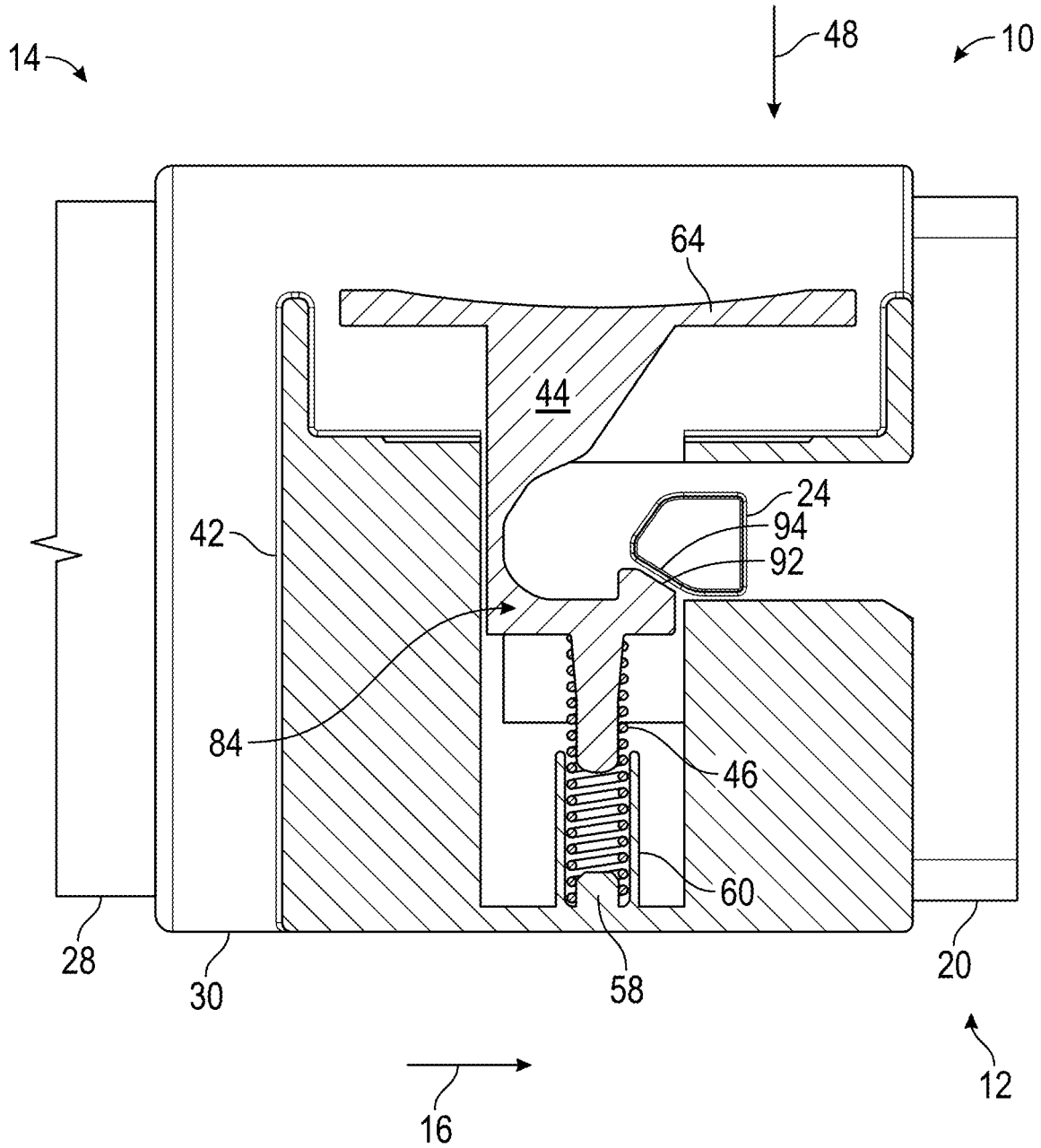
FIG. 10 is a cross-sectional view similar to FIG. 9 showing the electrical connector assembly in a pre-mate position relative to the header.

Referring to FIG. 10, there is illustrated a cross-sectional view similar to FIG. 9 with the electrical connector assembly 14 shown in a pre-mate position after being moved in the mate direction 16 relative to the header 12. As previously described, the header walls 20 extend into the header wall space 40 on the electrical connector assembly 14. As best shown in FIGS. 5 and 9, an opening 90 through the connector wall 30 extends between the header wall space 40 and the CPA space 52. The protrusion 24 passes through the opening 90 and extends into the CPA space 52.

Referring back to FIG. 10, the CPA 44 includes a first release surface 92 that is oriented at an angle between the mate direction 16 and the CPA direction 48. The protrusion 24 includes a second release surface 94 that is also preferably oriented at an angle between the mate direction 16 and the CPA direction 48. When the electrical connector assembly 14 is moved in the mate direction 16 relative to the header 12, the first release surface 92 on the CPA 44 engages the second release surface 94 on the protrusion 24. This causes a laterally directed force to be applied to the CPA 44 that moves the CPA 44 in the CPA direction 48 relative to the connector housing 26 and against the urging of the spring 46.

Figure 11:
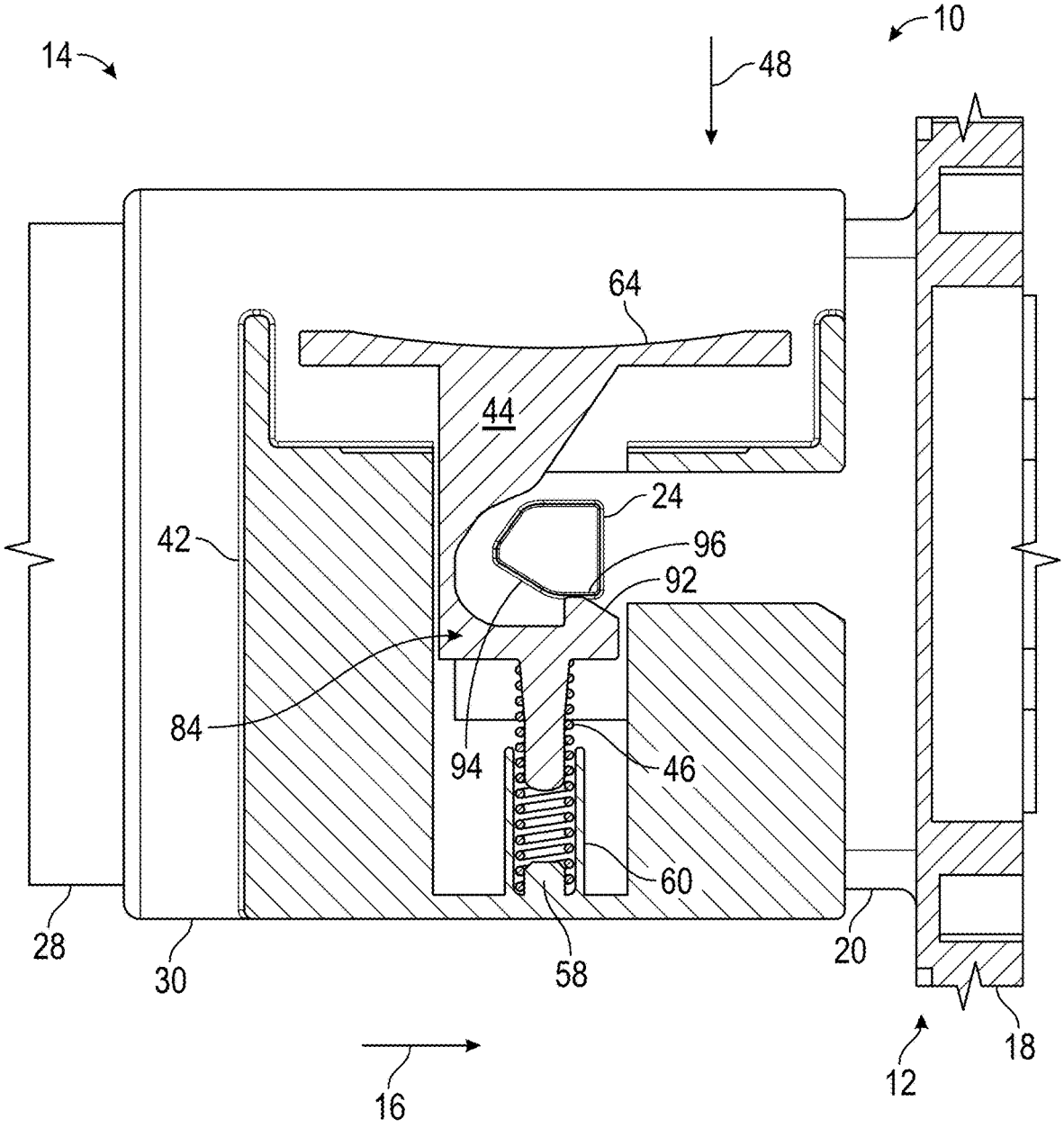
FIG. 11 is a cross-sectional view similar to FIG. 10 showing the electrical connector assembly in an intermediate position relative to the header.

Referring to FIG. 11, there is illustrated a cross-section similar to FIG. 10 with the electrical connector assembly 14 shown in an intermediate position after being moved farther in the mate direction 16 relative to the header 12. As a result, the electrical connector assembly 14 causes the CPA 44 to be moved in the CPA direction 48 relative to the connector housing 26 to an open position. The spring 46 is compressed and, thus, applies a force to the CPA 44 that presses the first release surface 92 against a retaining surface 96 on the protrusion 24. When located in the open position, the CPA 44 provides a visual indication to the operator that the electrical connector assembly 14 is not in the mated position relative to the header 12.

Figure 12:
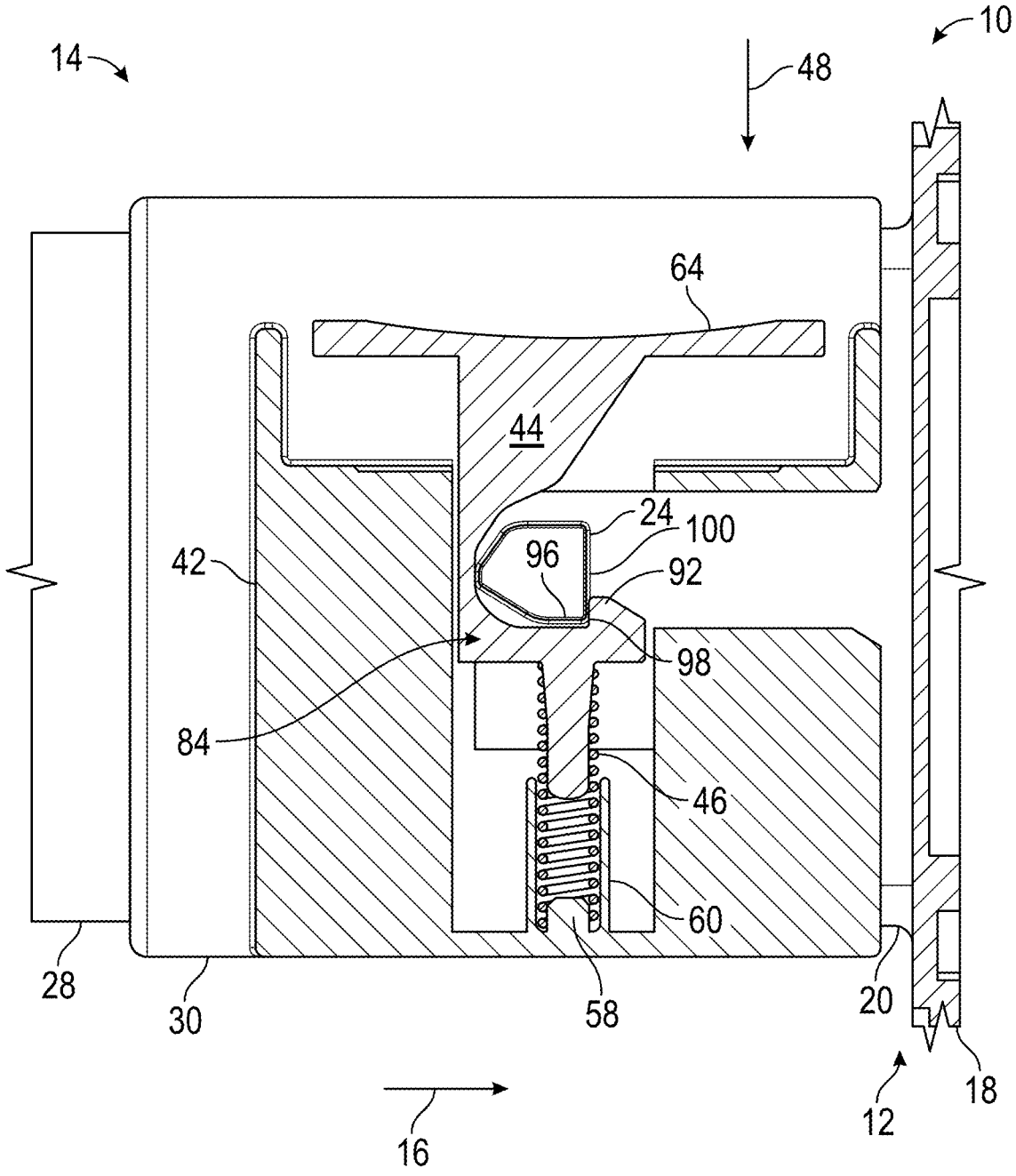
FIG. 12 is a cross-sectional view similar to FIG. 11 showing the electrical connector assembly in a mated position relative to the header.

Referring to FIG. 12, there is illustrated a cross-section similar to FIG. 11 showing the electrical connector assembly 14 shown in a mated position after being moved still farther in the mate direction 16 relative to the header 12. The first release surface 92 on the CPA 44 is shown after being moved past the retaining surface 96 on the protrusion, and the CPA 44 is shown after being moved opposite the CPA direction 48 relative to the connector housing 26 to the lock position. The CPA 44 includes a first lock surface 98 that is located in the mate direction 16 from a second lock surface 100 on the protrusion 24. Both the first lock surface 98 and the second lock surface 100 are generally perpendicular to the mate direction 16. The first lock surface 98 engages the second lock surface 100 to prevent the electrical connector assembly 14 from being moved opposite the mate direction 16 relative to the header 14. Thus, the illustrated CPA 44 acts as a lock to retain the electrical connector assembly 14 on the header 14.

The illustrated CPA 44 provides an audible indication to the operator that the electrical connector assembly 14 is in the mated position relative to the header 12 and provides a visual indication to the operator that the electrical connector assembly 14 is in the mated position relative to the header 12. As shown in FIG. 12, the first lock surface 98 and the second lock surface 100 are generally parallel to the CPA direction 48. Thus, when the first release surface 92 is moved past the retaining surface 96, the CPA 44 is moved to the lock position by the force of the spring 46. As previously described in reference to FIG. 8, the latches 78 engage the lock walls 88 to prevent further movement of the CPA 44 opposite the CPA direction 46. A sudden engagement of the latches 78 with the lock walls 88 can provide the audible indication when the CPA 44 is returned to the lock position. Additionally, the return of the push surface 64 to the position illustrated in FIGS. 8 and 12 can provide the visual indication that the electrical connector assembly 14 is in the mated position relative to the header 12.

Figure 13:
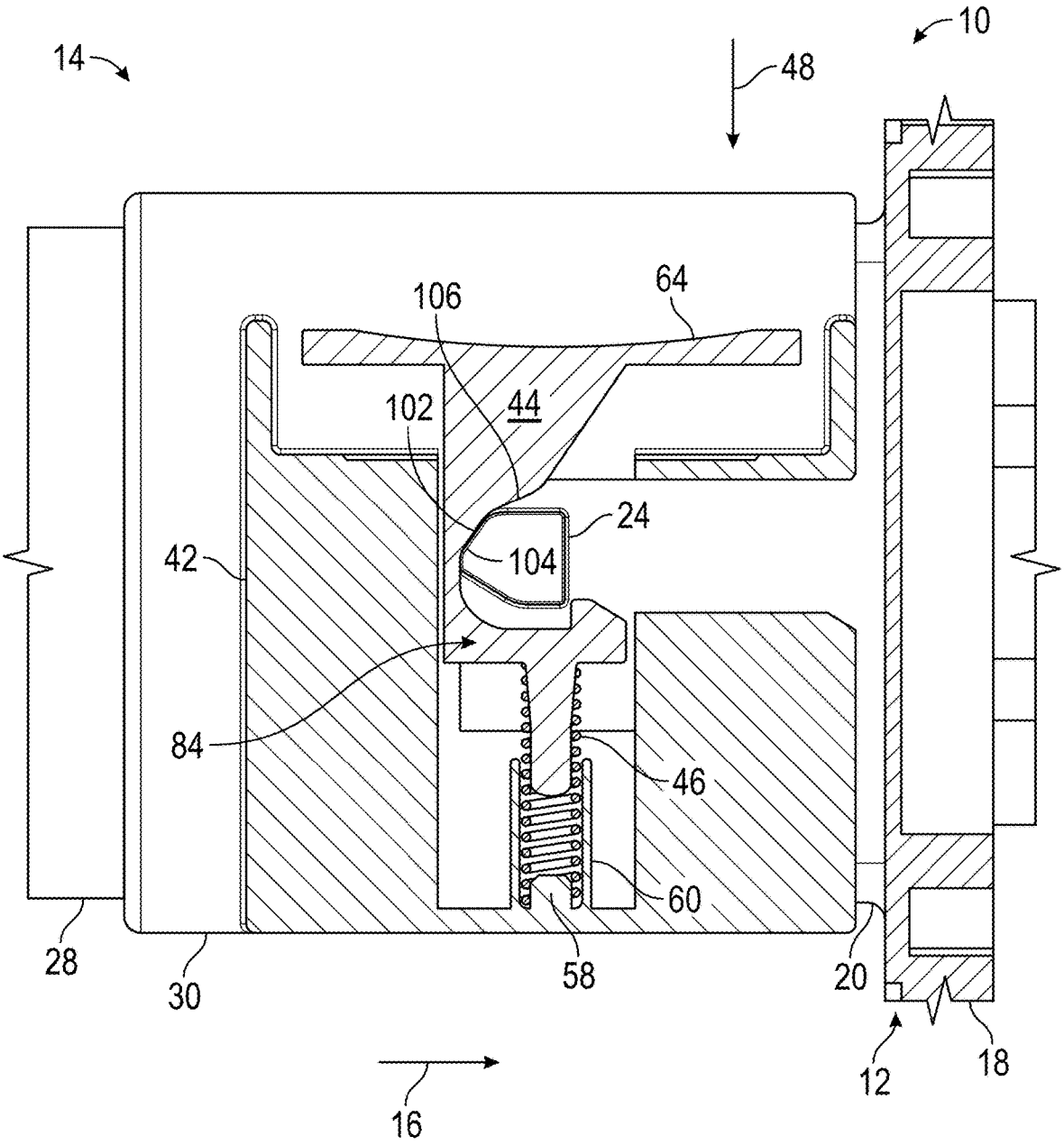
FIG. 13 is a cross-sectional view similar to FIG. 12 showing the connector position assurance in a release assist position relative to the header.

In accordance with this invention, the CPA 44 also provides a mechanical assist to help the operator move the electrical connector assembly 14 from the mated position relative to the header 12 to the unmated position. Referring now to FIG. 13, there is illustrated a cross-sectional view similar to FIG. 12, with the CPA 44 shown moved in the CPA direction 48 to a release assist position relative to the connector housing 26.

When the operator desires to unmate the electrical connector assembly 14 from the header 12, a force is applied to the electrical connector assembly 14 opposite the mate direction 16. As a result, the CPA 44 is moved in the CPA direction 48 until the first lock surface 98 does not engage the second lock surface 100. Additionally, the CPA 44 includes a first assist surface 102 that is moved into engagement with a second assist surface 104 that is provided on the protrusion 24. Both the first assist surface 102 and the second assist surface 104 are oriented at an angle that is between the mate direction 16 and the CPA direction 48. When the first assist surface 102 is moved into engagement with the second assist surface 104, a force is applied to the protrusion 24 that moves the electrical connector assembly 14 opposite the mate direction 16 relative to the header 12. This force helps the operator overcome the friction between the electrical connector assembly 14 and the header 12 that resists such relative movement.

In the illustrated embodiment, the first assist surface 102 includes a second stage 106, where the angle of the first assist surface 102 relative to the second assist surface 104 changes. This changes the amount of force applied to the protrusion 24 as the electrical connector assembly 14 is moved relative to the header 12. It should be appreciated that the relative angles of the first assist surface 102 and the second assist surface 104 may be selected to provide a desired amount of force and resistance to movement of the CPA 44.

In order to unmate the electrical connector assembly 14 from the header 12, the operator applies a force to the CPA 44 to move the CPA 44 linearly relative to the electrical connector assembly 14 back from the lock position in the CPA direction toward the open position. Additionally, the operator applies a force to the electrical connector assembly 14 to move the electrical connector assembly 14 linearly relative to the header 14 from the mated position opposite the mate direction 16 to the unmated position. When the operator stops applying force to the CPA 44, the CPA will return to the locked position described above in FIGS. 8 and 9.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A connector pair comprising:

a header including a protrusion; and an electrical connector assembly movable relative to the header between a mated position and an unmated position and including a connector housing and a CPA retained on the connector housing for relative movement between a lock position and an open position;

the CPA including a first lock surface that engages a second lock surface on the protrusion to retain the electrical connector assembly in the mated position, and the CPA including a first assist surface that engages a second assist surface on the protrusion to move the electrical connector assembly from the mated position toward the unmated position.

2. The connector pair of claim 1, wherein the first lock surface engages the second lock surface when the CPA is in the lock position, and wherein the first assist surface engages the second assist surface when the CPA is moved from the lock position to the open position.

3. The connector pair of claim 2, wherein the electrical connector assembly is movable linearly relative to the header between the mated position and the unmated position.

4. A connector pair comprising:

a header including a protrusion; and an electrical connector assembly movable relative to the header from an unmated position to a mated position and including a connector housing and a CPA retained on the connector housing for relative movement;

wherein, the electrical connector assembly is structured and configured so that when moved from the unmated position toward the mated position to an intermediate position, the protrusion engages the CPA to move the CPA relative to the connector housing from a lock position to an open position;

wherein, the electrical connector assembly is structured and configured so that when moved from the intermediate position to the mated position, the CPA is moved relative to the connector housing to the lock position, and the protrusion engages the CPA to retain the electrical connector assembly in the mated position; and wherein, the electrical connector assembly is structured and configured so that when in the mated position and the CPA is moved relative to the connector housing toward the open position, the CPA engages the protrusion to move the electrical connector assembly relative to the header from the mated position toward the unmated position.

5. The connector pair of claim 4, wherein the CPA is retained on the connector housing for relative linear movement.

6. The connector pair of claim 4, wherein the electrical connector assembly is movable in a mate direction relative to the header from the unmated position to the mated position, the CPA is movable in a CPA direction relative to the connector housing from the lock position to the open position, and the CPA direction is generally perpendicular to the mate direction.

7. The connector pair of claim 4, wherein the electrical connector assembly is linearly movable in a mate direction relative to the header from the unmated position to the mated position, the CPA is movable in a CPA direction relative to the connector housing from the lock position to the open position, and the CPA direction is generally perpendicular to the mate direction.

8. The connector pair of claim 4, wherein the CPA provides an audible indication when moved from the open position to the lock position.

9. The connector pair of claim 4, wherein the CPA provides a visual indication when moved from the open position to the lock position.

10. The connector pair of claim 9, wherein the CPA provides an audible indication when moved from the open position to the lock position.

11. An electrical connector assembly comprising:

a connector housing including a connector base and a plurality of connector walls that extend from the connector base in a mate direction and define a terminal space;

a CPA housing on one of the connector walls and defining a CPA space;

an opening through one of the connector walls that extends from the terminal space to the CPA space; and a CPA supported in the CPA housing for movement relative to the connector housing, the CPA including a plurality of ramp surfaces on a side facing the opening.

12. The electrical connector assembly of claim 11, wherein the CPA is adapted to serve as a primary latch to retain the connector housing on a second electrical connector.

13. The electrical connector assembly of claim 12, wherein the CPA is supported in the CPA housing for linear movement relative to the connector housing.

14. The electrical connector assembly of claim 11, wherein the CPA is adapted to serve as a mechanical assist to unmate the connector housing from a second electrical connector.

15. The electrical connector assembly of claim 14, wherein the CPA is supported in the CPA housing for linear movement relative to the connector housing.

16. The electrical connector assembly of claim 15, wherein the CPA is adapted to serve as a primary latch to retain the connector housing on a second electrical connector.

17. The electrical connector assembly of claim 14, wherein the CPA is adapted to serve as a primary latch to retain the connector housing on a second electrical connector.

* * * * *